US010993538B1

(12) United States Patent
Fenner

(10) Patent No.: US 10,993,538 B1
(45) Date of Patent: May 4, 2021

(54) SEAT APPARATUS FOR REPOSITIONING OF HEMORRHOIDS

(71) Applicant: Stephen Chester Fenner, Delray Beach, FL (US)

(72) Inventor: Stephen Chester Fenner, Delray Beach, FL (US)

( * ) Notice: Subject to any disclaimer, the term of this patent is extended or adjusted under 35 U.S.C. 154(b) by 0 days.

(21) Appl. No.: 16/992,685

(22) Filed: Aug. 13, 2020

(51) Int. Cl.
*A47C 7/02* (2006.01)
*A47C 9/00* (2006.01)

(52) U.S. Cl.
CPC ..... *A47C 7/029* (2018.08); *A47C 9/002* (2013.01); *A61H 2201/1633* (2013.01)

(58) Field of Classification Search
CPC .. A47C 7/029; A47C 9/002; A61H 2201/1633
See application file for complete search history.

(56) References Cited

U.S. PATENT DOCUMENTS 3,890,004 A * 6/1975 Rail ..... A47C 15/004 297/423.1
5,018,790 A * 5/1991 Jay ..... A61G 7/05715 297/452.26
5,317,773 A * 6/1994 Graebe ..... A47C 4/54 5/653
6,202,234 B1 * 3/2001 Henderson ..... A47C 7/021 5/653
8,136,876 B2 * 3/2012 Bellvis Castillo ..... A47C 9/025 297/195.11
8,713,733 B2 * 5/2014 Caforio ..... A47C 7/144 5/648
9,763,521 B2 * 9/2017 Krishtul ..... A47C 7/18
10,155,130 B2 * 12/2018 Piksa ..... A63B 21/4039
10,455,944 B2 * 10/2019 Chernin ..... A61G 5/124
10,729,612 B2 * 8/2020 Burns ..... A61H 15/0078

* cited by examiner

*Primary Examiner* — Philip F Gabler
(74) *Attorney, Agent, or Firm* — The Concept Law Group, PA; Scott M. Garrett; Scott D. Smiley

(57) ABSTRACT

A seat apparatus includes a base having a central ridge structure on the top of the base. The central ridge structure is round on the top and slopes downward from front to back. A secondary ridge structure may be included on top of the central ridge structure. Using the seat apparatus, a person with a hemorrhoid condition can sit on the seat apparatus, and using their own body weight, create pressure between the affected area and the central ridge structure. The pressure bias the hemorrhoid to be repositioned in the user's body, relieving discomfort and, with long term use, can improve sphincter control to better prevent hemorrhoid conditions.

16 Claims, 6 Drawing Sheets

SEAT APPARATUS FOR REPOSITIONING OF HEMORRHOIDS

FIELD OF THE INVENTION

The present invention relates generally to the treatment of hemorrhoids, and, more particularly, relates to an apparatus that can be used by and individual to comfortably reposition hemorrhoids while seated.

BACKGROUND OF THE INVENTION

Many people suffer from hemorrhoids, and experience ongoing or intermittent discomfort as a result. The pain caused by a hemorrhoid can be severe enough to prevent a person from engaging in ordinary daily tasks and activities. A wide range of treatments have been developed to help people cope with the discomfort. Some forms of treatment include ointments and other topical treatments to reduce or shrink the hemorrhoid. These are not easy to apply, and cannot be applied in public, and often have undesirable odors. Other treatments include devices that are used to cool the affected area as a form of relief. Often these require insertion of a portion of a device that is chilled, either passively or actively, into the anus. Obviously such applications are not able to be used in public.

Other means of treating hemorrhoids include seat devices. A common seat device for reliving discomfort includes a negative space (e.g. hole) over which a person positions the inflamed area, with the surrounding cushion supporting the person. These are commonly referred to as "donut" cushions due to their similarity to the toroid-shaped pastry of the same name. While a negative space cushion may provide some relief, it is not a solution to the problem. Another seat device is described in U.S. Pat. No. 7,942,151 which described a pair of rigid seat halves that are separated by a gap that acts as a negative space. The user sits on the seat with their anus over the gap, creating a "positive pressure" around the anus that is intended to cause a negative pressure inside the body to draw the hemorrhoid up into the body. However, the efficacy of this approach is limited, and requires the user to adjust the seat in order to adjust the pressure and location of the pressure being created.

Therefore, a need exists to overcome the problems with the prior art as discussed above.

SUMMARY OF THE INVENTION

In accordance with some embodiments of the inventive disclosure, there is provided a seat apparatus for repositioning a hemorrhoid that includes a base having a front edge, a back edge, a left edge, a right edge, and a top surface, where the base is rigid, flat, and planar. There is further provided a central ridge structure positioned at the top surface of the base that is located substantially equidistant between the right edge and the left edge of the base. The central ridge structure has an upward convex cross section profile, relative to the top surface of the base, in a direction from side to side, and slopes downward from a front of the central ridge structure to a rear of the central ridge structure. The front of the central ridge structure is adjacent the front edge of the base.

In accordance with a further feature, there is further included a secondary ridge structure disposed on a top of the central ridge structure adjacent the front of the central ridge structure. The secondary ridge structure has an upward convex cross section profile from side to side, and extends toward the rear of the central ridge structure.

In accordance with a further feature, the secondary ridge structure has an upward convex profile from front to rear.

In accordance with a further feature, the secondary structure extends one quarter to three quarters of an inch above the central ridge structure.

In accordance with a further feature, the central ridge structure has a width at the front from the central ridge structure, from a left bottom side to a right bottom side of the central ridge structure, of two to three and one half inches.

In accordance with a further feature, the rear of the central ridge structure is five to nine inches from the front of the central ridge structure.

In accordance with a further feature, the central ridge structure has a height at the front of the central ridge structure that is two to three inches.

In accordance with a further feature, the base is rectangular, and wherein the front edge and rear edge have a width of six to ten inches.

In accordance with a further feature, the base and the central ridge structure are made of a material that is one of plastic, metal, glass, or wood.

In accordance with a further feature, the base and central ridge structure are integrally formed.

In accordance with a further feature, there is further included a hole formed in the base at a front right corner or a front left corner of the base.

In accordance with some embodiments of the inventive disclosure, there is provided a seat apparatus for repositioning a hemorrhoid that includes a base having a front edge, a back edge, a left edge, a right edge, and a top surface, with the base being rigid, flat, and planar. There is further included a central ridge structure that extends upward from the top surface of the base, and has a conic section shape, and has a front and a rear. The front of the central ridge structure is adjacent the front edge of the base and the central ridge structure extends from the front of the base towards the rear edge of the base. The conic section has a highest point above the top surface of the base at the front. A top of the conic section slopes downward from the highest point to the rear of the central ridge structure. There is also included a secondary ridge structure formed on the top of the conic section at the front of the central ridge structure that extends upward from the top of the central ridge structure. The central ridge structure is located midway between the left edge of the base and the right edge of the base.

In accordance with a further feature, the secondary ridge structure has an upward convex cross section profile from side to side, and extends toward the rear of the central ridge structure.

In accordance with a further feature, the secondary ridge structure has an upward convex profile from front to rear.

In accordance with a further feature, the secondary structure extends one quarter to three quarters of an inch above the central ridge structure.

In accordance with a further feature, the central ridge structure has a width at the front from the central ridge structure, from a left bottom side to a right bottom side of the central ridge structure, of two to three and one half inches.

In accordance with a further feature, the rear of the central ridge structure is five to nine inches from the front of the central ridge structure.

In accordance with a further feature, the central ridge structure has a height at the front of the central ridge structure that is two to three inches.

In accordance with a further feature, the base is rectangular, and wherein the front edge and rear edge have a width of six to ten inches.

In accordance with a further feature, the central ridge structure has a left bottom side and a right bottom side that converge adjacent the rear of the central ridge structure and each follow a parabolic curve inward.

Although the invention is illustrated and described herein as embodied in a seat apparatus for treatment of hemorrhoids, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
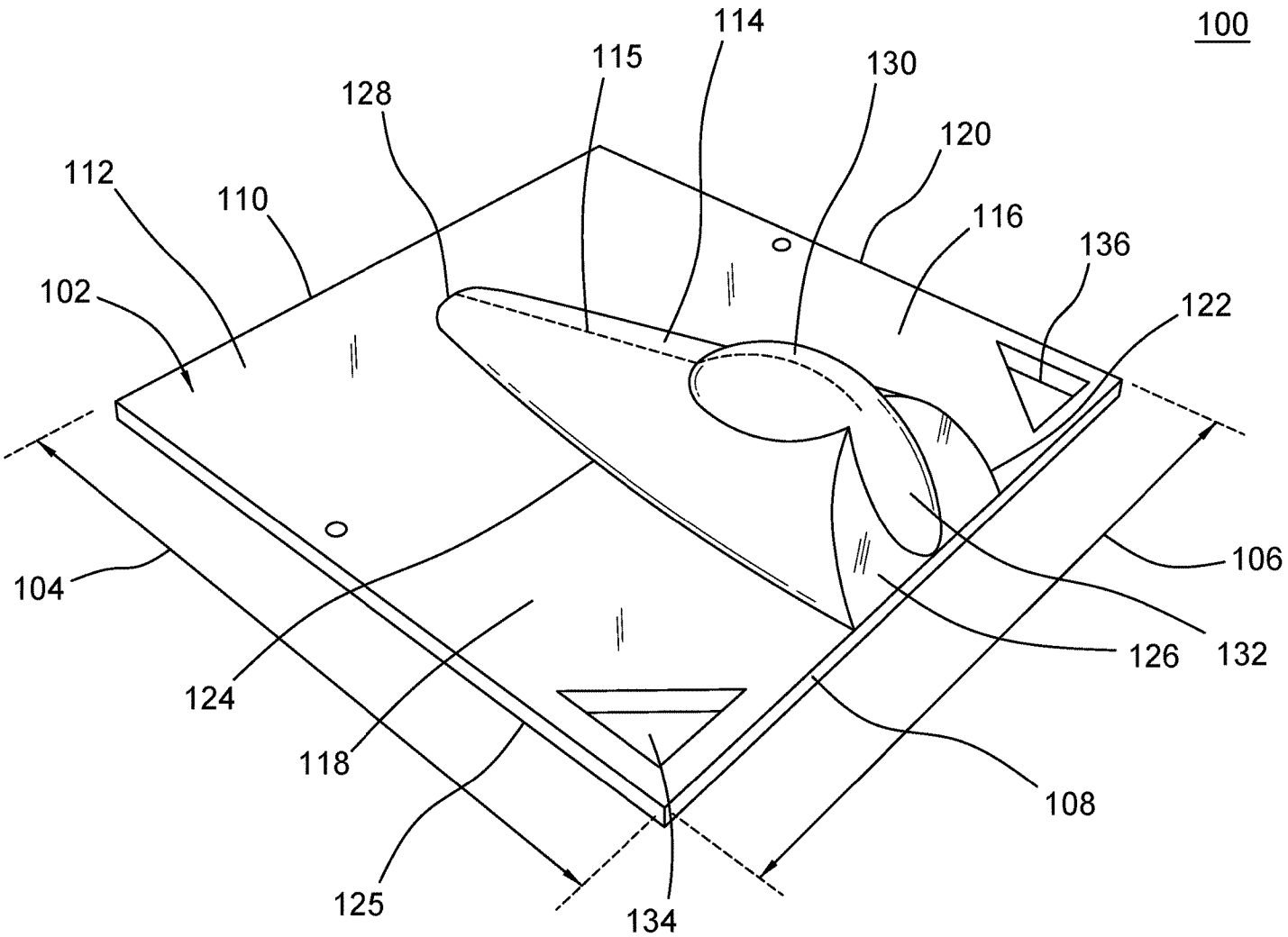
FIG. 1 is a perspective view of a seat apparatus for repositioning a hemorrhoid from the top front right, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present disclosure provides a novel and efficient means for the treatment of hemorrhoids. Embodiments of the disclosure provide a seat apparatus that includes a central ridge structure. Upon sitting on the seat apparatus, the user's body will bear against the central ridge structure, imparting pressure against the affected area, urging the hemorrhoid to reposition inside the user's body. In addition, embodiments of the disclosure provide a seat apparatus that requires no adjustment, and can be used in public while wearing clothes. The central ridge structure is shaped to allow the user to position their body on the seat apparatus such that a desired amount of pressure is experienced between their body and the central ridge structure, and the user can reposition their body to achieve more or less pressure. In some embodiments a secondary ridge structure can be positioned on top of the central ridge structure to provide finer, more localized pressure, at the user's discretion.

Figure 2:
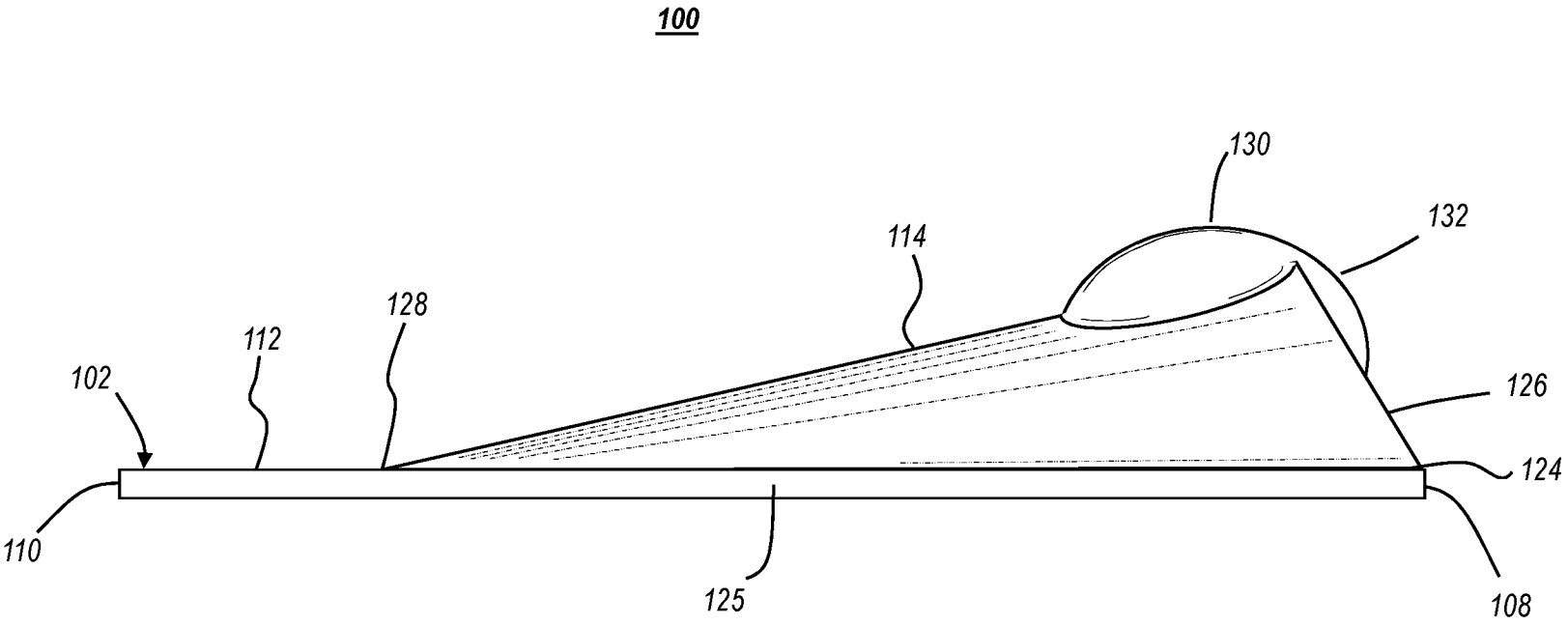
FIG. 2 is a right side elevational view of a seat apparatus for repositioning a hemorrhoid, in accordance with some embodiments.
Figure 3:
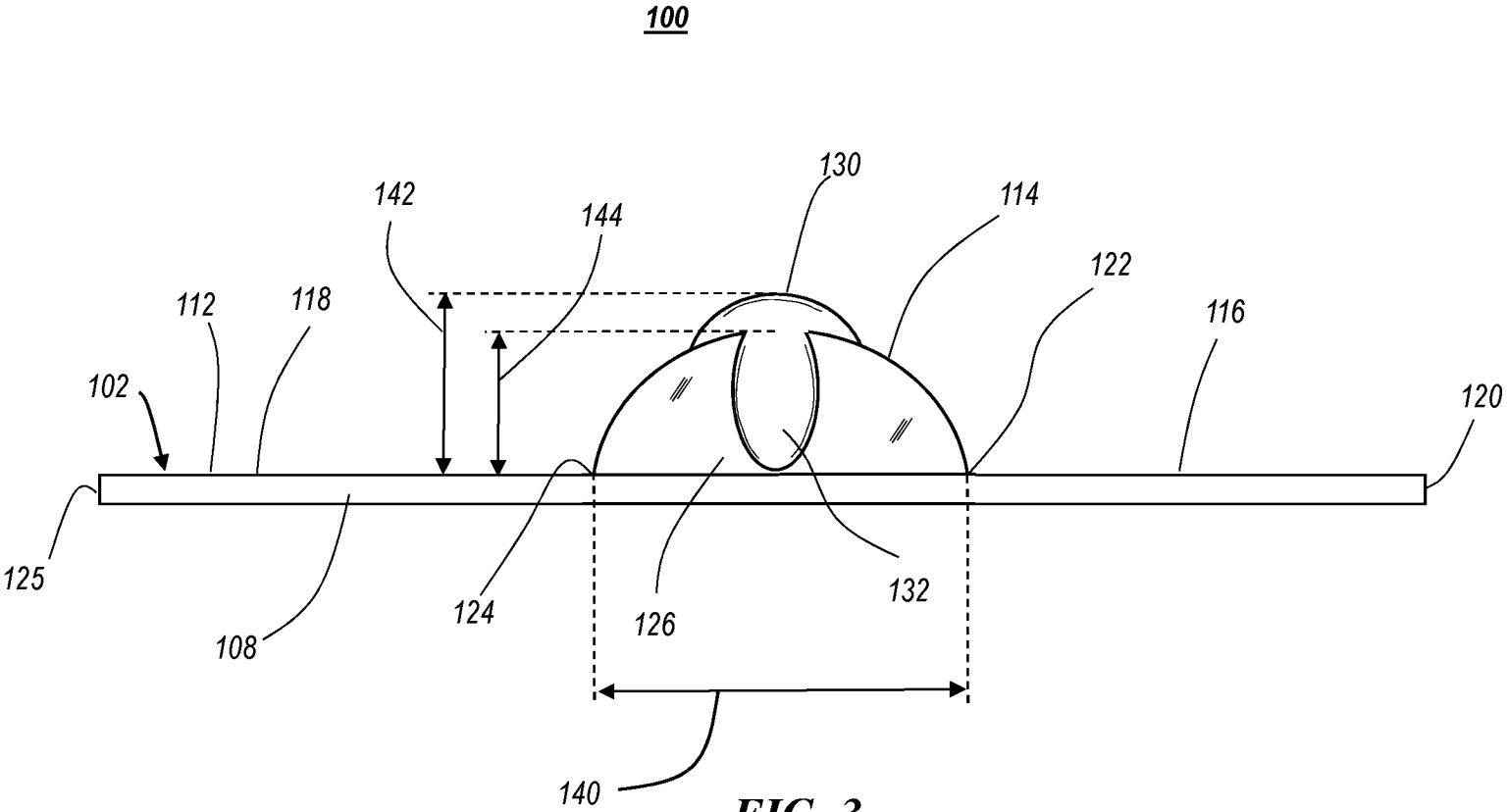
FIG. 3 is a front elevational view of a seat apparatus for repositioning a hemorrhoid, in accordance with some embodiments.
Figure 4:
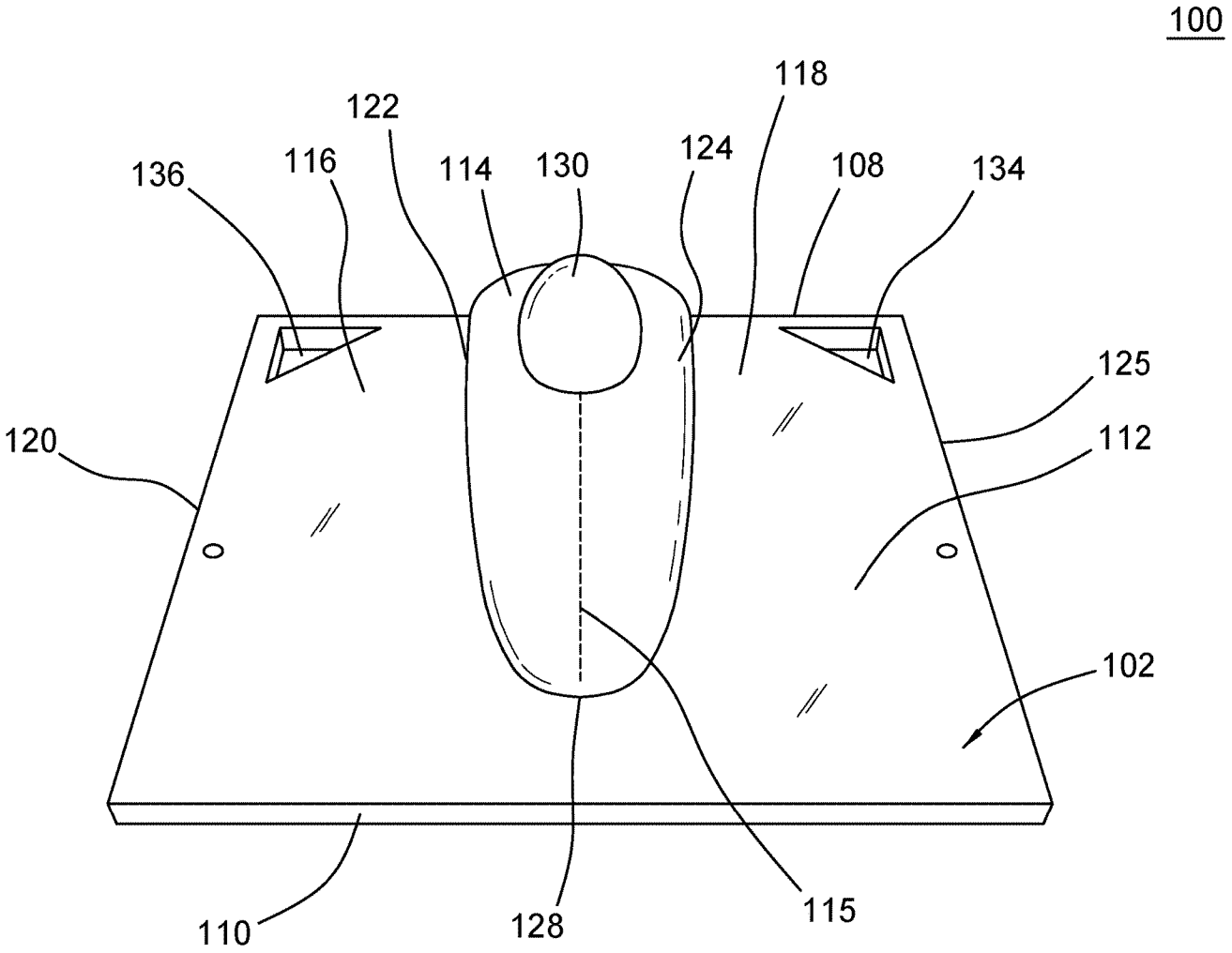
FIG. 4 is a top rear perspective view of a seat apparatus for repositioning a hemorrhoid, in accordance with some embodiments.

FIG. 1 is a perspective view of a seat apparatus 100 for repositioning a hemorrhoid from the top front right, in accordance with some embodiments. FIGS. 2-4 show alternate views of the seat apparatus 100, and should be referred to in the following discussion. The seat apparatus 100 allows a user to apply a selected level of pressure directly to the hemorrhoid in order to reposition it back into the user's body. The user can adjust the amount of pressure being applied based on where they position their body on the seat apparatus 100. Thus, the user does not need to adjust the seat apparatus 100 itself, and the seat apparatus 100 can be manufactured with no moving parts. Further, because the seat apparatus applies a positive pressure to the affected area and the user can adjust the amount of pressure being applied, the user has control over the effect of using the seat apparatus 100.

The seat apparatus 100 includes base 102 that is, generally, flat and rigid and planar. The base 102 can be placed on a seat, such as a chair or other surface so that the base 102 is generally horizontal. The base 102 has a front side or front edge 108 and a back side or back edge 110, and a length 104 from front to back. The base 102 also has a left side or left edge 120 and a right side or right edge 125, and a width 106 from side to side. In the subsequent discussion, the phrase "side to side" shall refer to a direction from the left side 120 to the right side 125, or vice versa. In some embodiments the base 102 can be square, having a length 104 and width 106 on the order of nine inches by nine inches. In some embodiments the shape of the base 102 can vary and have different dimensions. In general the base 102 is intended to be rigid to support a user's body weight without substantially deforming. The base 102 further has a top surface 112 that faces upwards when being used, and is the surface on which the user sits when using the seat apparatus 100.

Located centrally from side to side is a central ridge structure 114. The central ridge structure 114 rises from the base 102 at a rear portion 128, which may be located forward from the rear side 110 on the base 102, and slopes upward toward the front side 108. As used here, the term "rises" does not imply an action or motion on the part of the central ridge structure 114, rather it is descriptive of the shape of the central ridge structure 114 generally from the rear to the front of the seat apparatus 100. The apex line 115 is drawn along the highest point of the central ridge structure 114 from rear to front. In general, the central ridge structure is rounded from side to side, having a generally semi-circular cross section from the right bottom side 124 to the left bottom side 122 of the central ridge structure 114 where the central ridge structure 114 meets the top surface 112 of the base 102. The cross section of the central ridge structure 114 can have other generally upward convex shapes (e.g. rounded upward relative to the top surface of the base) so long as the top region is sufficiently rounded to not cause discomfort.

Between the right bottom side 124 of the central ridge structure 114 and the right side 125 of the base is a right leg area 118, and between the left bottom side 122 of the central ridge structure 114 and the left side 120 of the base 102 is a left leg area 116. When sitting on the seat apparatus 100, the users right buttock/leg will be disposed in the right leg area 118, and the user's left buttock/leg will be in the left leg area 116. The user's anal region will then be positioned over the central ridge structure 114, and the user's body weight will cause the user's anal region to bear against the central ridge structure 114. Accordingly, by virtue of the sloped shape of the central ridge structure 114, the user can adjust their body forward or rearward while sitting on the seat apparatus in order to adjust the pressure being exerted on their anal region. The pressure biases or urges the user's hemorrhoid to reposition it back into the user's body.

The central ridge structure can start at the front side 108, having a flat front 126 that shows the generally semi-circular profile from side to side, and is generally convex upward relative to the top surface 112 of the base 102. At the front side, the width 140 at the base of the central ridge structure 114 can be on the order of two to three inches in some embodiments, and wider or narrower in some embodiments. The central ridge structure 114 can have a peak height 144 at the top of the flat front of about two to three inches in some embodiments, and can be shorter or higher in some embodiments. The left bottom side 122 and right bottom side 124 of the central ridge structure 114 can each follow opposing and generally parabolic curves, getting closer to each other at the rear 128 of the central ridge structure 114. Further, the central ridge structure 114 can have a length, from the front side 108 to the rear 128 of the central ridge structure 114 of about six to eight inches in some embodiments, and can be longer or shorter in some embodiments.

At the front of the central ridge structure 114 and on the top of the central ridge structure 114 there can be a secondary ridge structure 130. The secondary ridge structure 130 can also have a generally rounded profile from side to side, and is narrower from side to side that the width 140 of the central ridge structure 114, and is generally bi-directionally convex in shape relative to the outer surface of the central ridge structure 114. That is, it is convex from side to side, as well as from front to rear of the secondary ridge structure 130. The secondary ridge structure 130 can extend upward (e.g. height 142) from the central ridge structure 114 another one quarter to one half an inch in some embodiments, or more or less in some embodiments. However, the peak, from front to rear, of the secondary ridge structure 130 is behind the peak, from front to rear, of the central ridge structure 114 (e.g. at the top of the flat front 126 if it were exposed) because the secondary ridge structure 130 is also rounded from front to back, and thus the peak of the secondary ridge structure 130 can be located one half to one and one half inches behind the highest point of the central ridge structure if were exposed. The secondary ridge structure 130 can extend a distance of one to three inches along the top of the central ridge structure 114 in some embodiments, and shorter or farther in some embodiments.

In practice, the central ridge structure 114 and the secondary ridge structure 130 are integrally formed and are not separate parts. The secondary ridge structure 130 provides narrower and higher structure against which the user can bear in order to reposition a hemorrhoid by providing finer control of the application of pressure to the affected region. The secondary ridge structure 130 can continue over the front of the central ridge structure 114, producing a front protrusion 132 on the flat front 126 of the central ridge structure 114. The front protrusion is also rounded from side to side and top to bottom, having a convex shape relative to the surface of the flat front 126 of the central ridge structure 114. The front protrusion 132 can be taller than it is wide on the flat front 126 as well. As a result, the secondary ridge structure 130 and the front protrusion 132 appear as a contiguous shape embedded in the top front of the central ridge structure 114 such that the front protrusion 132 follows the curve of the secondary ridge structure 130 over the front of the central ridge structure 114.

To use the seat apparatus 100, the user sits on the top surface 112 of the seat apparatus 100 with the user's right buttock/leg in the right leg area 118 and the user's left buttock/leg in the left leg area 116 with their legs extending forward beyond the front side 108 of the base 102. In this position, the central ridge structure 114 will be aligned with their anus. The user can position their body to the rear, or more to the front, as desired, to control the pressure exerted on the hemorrhoid. The repositioning occurs over a period of time, which will vary from user to user based on the particular circumstance of their condition and their familiarity with using the seat apparatus 100. Some users will sit on the seat apparatus 100 for only a few seconds, while others may require more time. The seat apparatus 100 can also include handle holes 134, 136 on the front left and right corners to allow the user to carry the seat apparatus 100. Accordingly, the seat apparatus 100 can be used while wearing clothes, and thus can be used in public or in view of other people.

Figure 5:
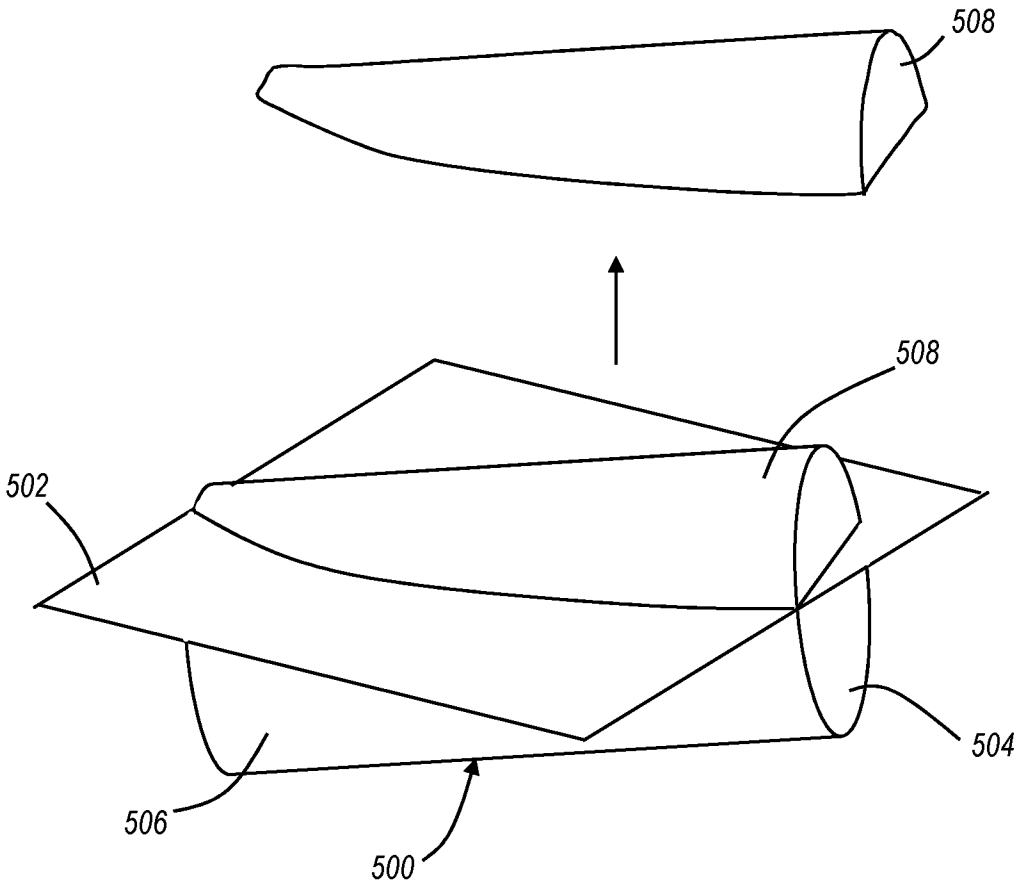
FIG. 5 is a perspective view of a cylindrical section to illustrate a geometry of a central ridge to be used on a seat apparatus for repositioning a hemorrhoid, in accordance with some embodiments.

FIG. 5 is a perspective view of a cylindrical section to illustrate a geometry of a central ridge structure to be used on a seat apparatus for repositioning a hemorrhoid, in accordance with some embodiments. In some embodiments the central ridge structure can be shaped similarly to a conic section 508 of a cylinder 500. The cylinder 500 can be a right cylinder or an oblique cylinder, and can be circular or non-circular (e.g. elliptical or oval). A plane 502 indicates a cut through the cylinder 500. The plane 502 is not parallel to the axis of the cylinder 500, and cuts through one end 504 of cylinder 500 and through the side wall of the cylinder or through the opposite end of cylinder 500 near the side wall. The conic section 508 can represent a shape of the central ridge structure (e.g. 114). Where the plane 502 represents a flat bottom of the conic section 508 that can be located on the top surface of the seat apparatus.

Figure 6:
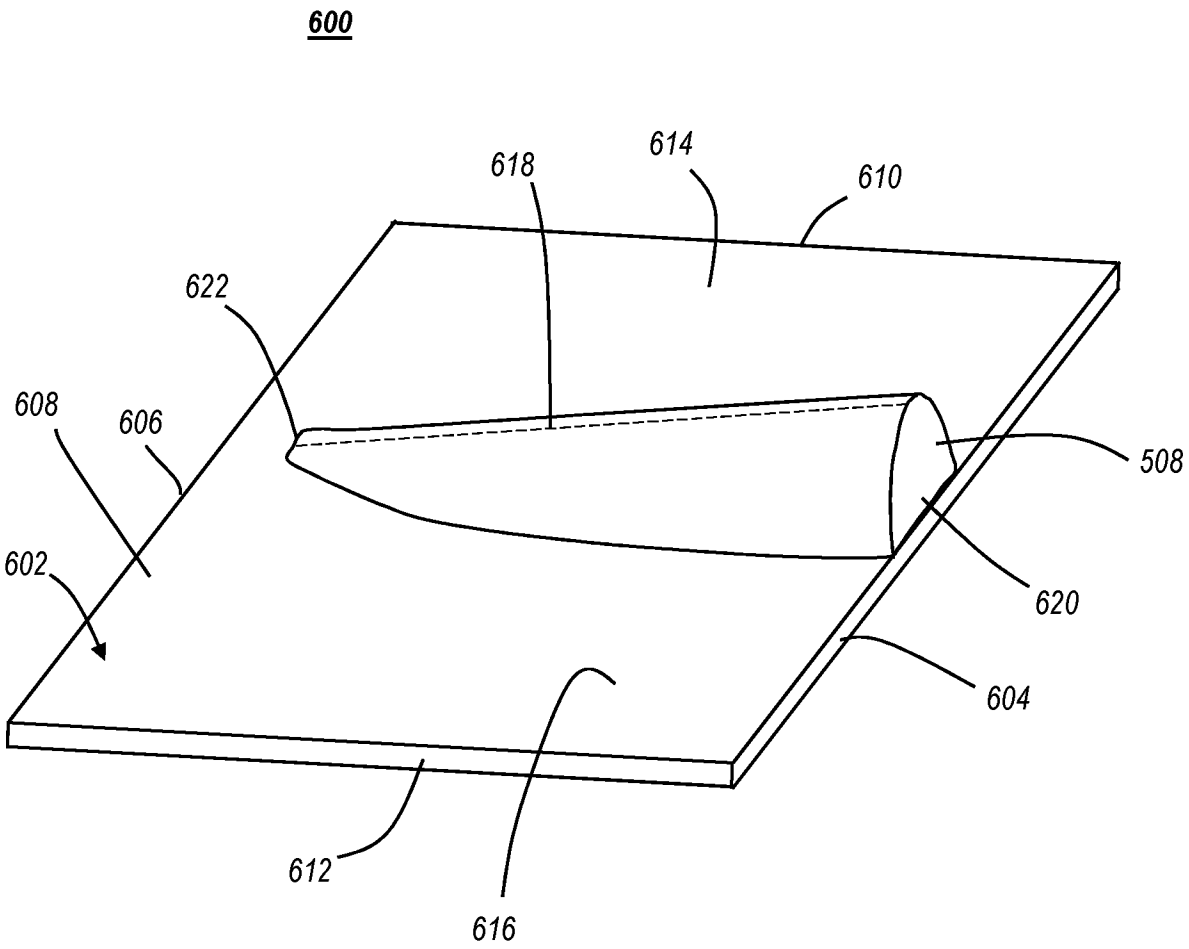
FIG. 6 shown a top right side perspective view of a seat apparatus for repositioning a hemorrhoid, in accordance with some embodiments.

FIG. 6 shown a top right side perspective view of a seat apparatus 600 for repositioning a hemorrhoid, in accordance with some embodiments. The seat apparatus 600 is substantially similar to that of FIGS. 1-4 without the secondary ridge structure 130. Accordingly, seat apparatus 600 includes a base 602 that can be flat, rigid, and generally planar. The seat apparatus 600 has a top surface 608, a front 604, a rear 606, a left side 610 and a right side 612. Conic section 508 extends upward from the top surface 608 of the base 602 to form a central ridge structure. Generally the conic section 508 is centrally located between the left and right sides 610, 612, and the front 620 of the conic section 508 is positioned at the front 604 of the base 602. The rear 622 of the conic section 508 is disposed near the rear 606 of the base 602. Apex line 618 represents the highest point, from side to side, of the conic section 508, and it can be seen that the conic section 508 slopes upward from rear to front (or downward in the opposite direction).

The conic section 508 shown here is convex from side to side, and generally has a semi-circular cross section or profile from side to side, although other convex shapes can be used. Further, although the conic section 508 is shown with a straight slope along apex line 618, other shapes can be used equivalently. For example, the conic section 508 can be a central ridge structure that is convex, or concave (e.g. saddle shaped) from front to rear. Also, rather than a circular cross section, in some embodiments the cross section can be more triangular shaped. Secondary ridge structures can be further included on the top or uppermost portion of the central ridge structure as well.

To use the seat apparatus 600, the user sits on the seat apparatus 600 with the left buttock/leg positioned in left leg area 614, between the left side of the conic section 508 the left side 610 of the base 602, and their right buttock/leg in the right leg area 616, between the right side of the conic section 508 and the right side 612 of the base 602. The user can move back or forward to achieve the desired level of pressure to reposition their hemorrhoid back into their body. Over time the user will learn how best to sit on the seat apparatus to achieve the desired result.

The seat apparatus (e.g. 100, 600) can be made of discrete components that are assembled together in the form(s) shown herein. Alternatively, the entire seat apparatus can be molded as a complete unit using a rigid polymeric material. The convex shapes of the ridge structures allow simple molding of the seat apparatus.

A seat apparatus for use in repositioning hemorrhoids has been disclosed that allows a user to apply only as much pressure as necessary to reposition their hemorrhoid. The seat apparatus design is such that it needs no adjustment. Instead, the user can adjust the pressure magnitude and position by adjusting their seating position while sitting on the seat apparatus. The sloped central ridge structure allows the user to position their body over the central ridge structure to achieve the optimum level of pressure, and it allows people a various body types/shapes to adjust their position accordingly. By applying their own body weight against the seat apparatus a person can reposition a hemorrhoid in seconds to minutes. Repeated use of the seat apparatus can train the natural memory function of the sphincter muscle to better maintain future hemorrhoid control as well. The seat apparatus can be made of any sufficiently rigid material, include plastics, metals, glass, or wood.

The claims appended hereto are meant to cover all modifications and changes within the scope and spirit of the present invention.

What is claimed is:

1. A seat apparatus for repositioning a hemorrhoid, comprising:

a base having a front edge, a back edge, a left edge, a right edge, and a top surface, the base being rigid, flat, and planar;

a central ridge structure positioned at the top surface of the base and being located substantially equidistant between the right edge and the left edge of the base, the central ridge structure having an upward convex cross section profile, relative to the top surface of the base, in a direction from side to side, and sloping downward from a front of the central ridge structure to a rear of the central ridge structure, wherein the front of the central ridge structure is adjacent the front edge of the base, wherein the central ridge has a width of two to three inches at the front of the central ridge along the base, and a peak height of two to three and one half inches; and a secondary ridge structure disposed on a top of the central ridge structure adjacent the front of the central ridge structure, wherein the secondary ridge structure has an upward convex cross section profile from side to side, and extends toward the rear of the central ridge structure, wherein the secondary ridge structure extends one quarter to three quarters of an inch above the peak height of the central ridge structure, and from the front of the central ridge structure one to three inches along a top of the central ridge structure;

wherein the central ridge structure and the secondary ridge structure are rigid.

2. The seat apparatus of claim 1, wherein the secondary ridge structure has an upward convex profile from front to rear.

3. The seat apparatus of claim 1, wherein the rear of the central ridge structure is five to nine inches from the front of the central ridge structure.

4. The seat apparatus of claim 1, wherein the base is rectangular, and wherein the front edge and rear edge of the base have a width of six to ten inches.

5. The seat apparatus of claim 1, wherein the base and the central ridge structure are made of a material that is one of plastic, metal, glass, or wood.

6. The seat apparatus of claim 1, wherein the base and central ridge structure are integrally formed.

7. The seat apparatus of claim 1, further comprising a hole form in the base at a front right corner or a front left corner of the base.

8. A seat apparatus for repositioning a hemorrhoid, comprising:

a base having a front edge, a rear edge, a left edge, a right edge, and a top surface, the base being rigid, flat, and planar;

a central ridge structure that extends upward from the top surface of the base, and has a conic section shape, and has a front and a rear, the front of the central ridge structure is adjacent the front edge of the base and the central ridge structure extends to the rear edge of the base, the central ridge structure having a highest point above the top surface of the base at the front, and wherein a top of the central ridge structure slopes downward from the highest point to the rear of the central ridge structure, wherein the central ridge has a width of two to three inches at the front of the central ridge along the base, and a height of two to three and one half inches at the highest point; and a secondary ridge structure formed on the top of the central ridge structure at the front of the central ridge structure that extends upward from the top of the central ridge structure one half to three quarters of an inch above the top of the central ridge structure, and which extends one to three inches along the top of the central ridge structure from the front of the central ridge structure;

wherein the central ridge structure is located midway between the left edge of the base and the right edge of the base; and wherein the central ridge structure and the secondary ridge structure are rigid.

9. The seat apparatus of claim 8, wherein the secondary ridge structure has an upward convex cross section profile from side to side, and extends toward the rear of the central ridge structure.

10. The seat apparatus of claim 9, wherein the secondary ridge structure has an upward convex profile from front to rear.

11. The seat apparatus of claim 8, wherein the rear of the central ridge structure is five to nine inches from the front of the central ridge structure.

12. The seat apparatus of claim 8, wherein the base is rectangular, and wherein the front edge and rear edge of the base have a width of six to ten inches.

13. The seat apparatus of claim 8, wherein the central ridge structure has a left bottom side and a right bottom side that converge adjacent the rear of the central ridge structure and each follow a parabolic curve inward.

14. A seat apparatus for self-repositioning of a hemorrhoid by a user, comprising:

a flat base having a left leg area and a right leg area;

a central ridge structure disposed between the left leg area and the right leg area which extends upward from the base to a peak height at a front of the central ridge structure of two to three and a half inches, and which slopes downward to the base at a rear of the central ridge structure from the front of the central ridge structure, and wherein the central ridge structure has a width of two to three and half inches at a front of the central ridge structure along the base, and wherein the central ridge structure narrows in width from the front to the rear of the central ridge structure; and a secondary ridge structure formed on a top of the central ridge structure at the front of the central ridge structure that rises one half to three quarters of an inch above the top of the central ridge structure and one to three inches along the top of the central ridge structure from the front towards the rear of the central ridge structure;

wherein the flat base, central ridge structure, and secondary ridge structure are integrally formed of a rigid material.

15. The seat apparatus of claim 14, wherein the secondary ridge structure has an upward convex cross section profile from side to side.

16. The seat apparatus of claim 14, wherein the secondary ridge structure has an upward convex profile from front to rear.

* * * * *